United States Patent [19]

York

[11] 4,276,808

[45] Jul. 7, 1981

[54] ATTACHMENT FOR FIREARMS

[76] Inventor: Norman N. York, 3703 Broadway, Houston, Tex. 77017

[21] Appl. No.: 70,143

[22] Filed: Aug. 27, 1979

[51] Int. Cl.[3] ..... F41C 19/00

[52] U.S. Cl. ..... 89/136

[58] Field of Search ..... 89/27 D, 27 F, 27 G, 89/128, 132, 133, 136

[56] References Cited

U.S. PATENT DOCUMENTS

| | | | |
|---|---|---|---|
| 1,595,993 | 8/1926 | Cecero | 89/133 |
| 2,948,194 | 8/1960 | Godar | 89/129 B |
| 2,976,771 | 3/1961 | Lambert | 89/129 B |
| 3,345,914 | 10/1967 | Newcomb et al. | 89/129 B |
| 3,788,191 | 1/1974 | Rose et al. | 89/129 B |
| 3,847,054 | 11/1974 | Ruger et al. | 89/129 B |
| 4,020,740 | 5/1977 | Schirneker | 89/129 B |
| 4,117,761 | 10/1978 | Johnson et al. | 89/129 B |

*Primary Examiner*—Stephen C. Bentley

*Attorney, Agent, or Firm*—Gunn, Lee & Jackson

[57] ABSTRACT

An attachment for a semiautomatic weapon constructed with a trigger and trigger guard is disclosed, and the preferred embodiment incorporates a clamp means adapted to be releasably attached to the trigger guard, a rotor means pivotally supported by said clamp means for rotation about an axis to drive a movable striker means in a reciprocating fashion against the trigger enclosed by the trigger guard. A laterally extending handle equipped with a knob at the outer end is rotatable to turn a shaft which, in turn, rotates the rotor.

7 Claims, 2 Drawing Figures

FIG. 1
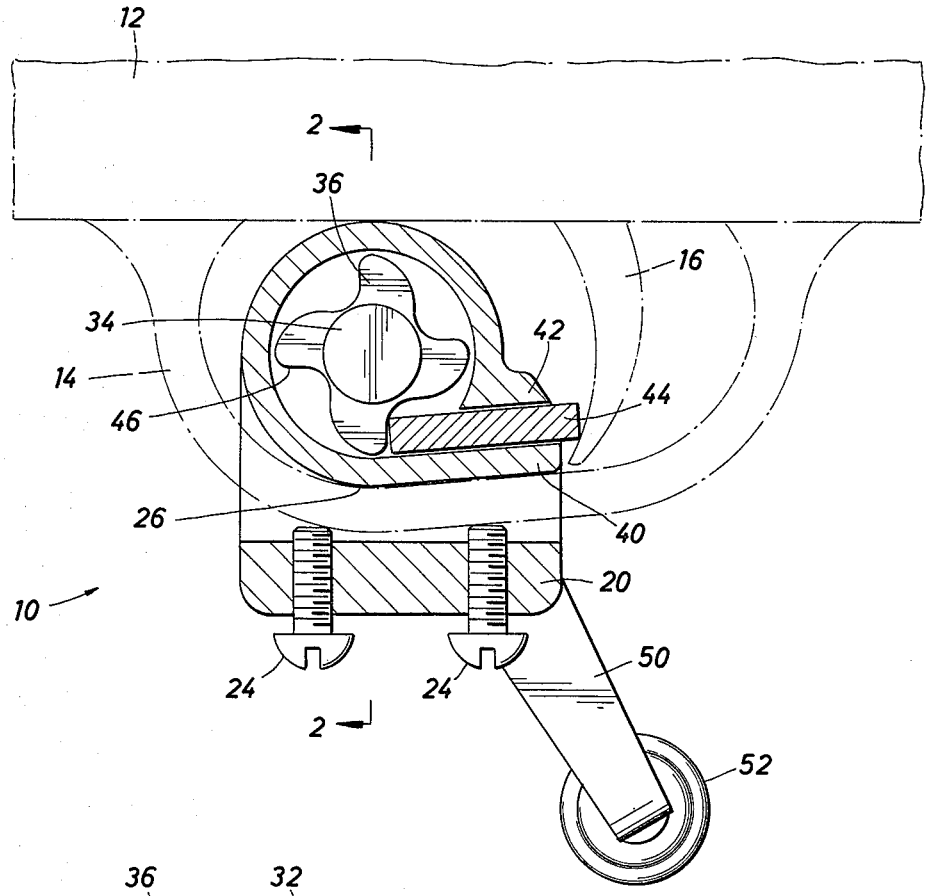
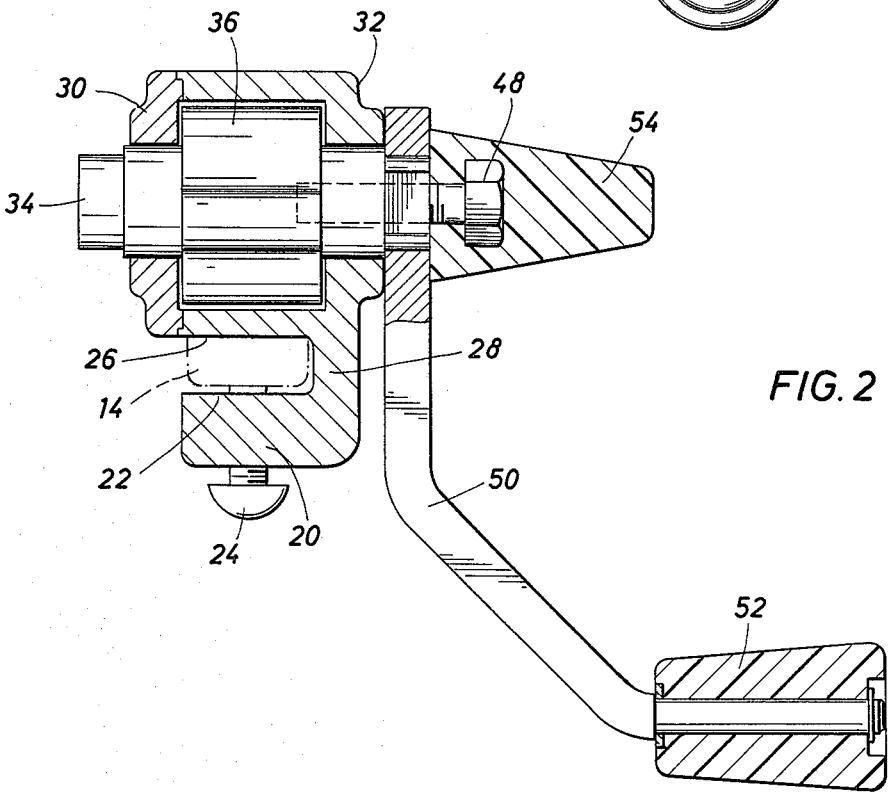
FIG. 2

ATTACHMENT FOR FIREARMS

BACKGROUND OF THE DISCLOSURE

This apparatus is directed to an attachment for preexistent semiautomatic weapons. In particular, it is intended to cooperate with rifles handling 22-gauge ammunition of the semiautomatic variety. As exemplified in U.S. Pat. No. 3,788,191, a very complex mechanism assists in making a rapid fire weapon. It is unduly complex and expensive. An equally complex structure is shown in U.S. Pat. No. 4,117,761. Major reconstruction of the trigger and connected apparatus is required in U.S. Pat. No. 2,948,194. A very limited two-round burst firing mechanism is disclosed in U.S. Pat. No. 3,345,914.

These references and others of similar construction fairly well set forth the nature of the apparatus required to achieve burst firing of a weapon. The present apparatus is a conversion apparatus for use with a preexistent semiautomatic rifle constructed with a trigger and trigger guard. It enables burst firing from the weapon by implementing a conversion which, while permitting burst firing, does not violate registration laws of the United States for automatic weaponry. This conversion is achieved in a relatively inexpensive manner and is, indeed, an inexpensive structure.

The apparatus of the present invention is relatively lightweight and easy to install, subsequently removable after installation and is operable with a minimum of instruction, practice or skill. It can be installed on a weapon such as a rifle of the semiautomatic variety constructed with a trigger and trigger guard, certainly a weapon that is not extraordinarily expensive, and can be converted in the matter of a few minutes on installation of the present apparatus. Such a conversion will yield a semiautomatic weapon which is able to fire at a rate of speed primarily determined by the semiautomatic construction of the weapon and the maximum rate permitted by that construction.

This apparatus is relatively inexpensive in construction, being formed of a high quality, high impact plastic. The parts are assembled with relative ease, and one of the advantages and features of the present invention is the incorporation of a clamp mechanism utilizing clamping screws to attach to the trigger guard. It is adaptable for many constructions of semiautomatic weapon, able to accommodate variations in the trigger guard and can be removed after use and reinstalled on another weapon.

With the foregoing advantages in mind, the apparatus of this disclosure is, therefore, summarized as an accessory or attachment for a semiautomatic rifle, typically of the 22-caliber variety, which is constructed with a trigger enclosed in a trigger guard. This attachment affixes to the trigger guard by means of a clamp having a U-shaped construction to encircle the trigger guard and further comprising a set of clamp screws which extend through the clamp to pinch the trigger guard. The apparatus additionally includes a hollow housing having a shaft through it, the shaft supporting a rotor and the rotor moving against a striker rod. The striker rod protrudes toward the trigger and is pushed against the trigger by the rotor. The apparatus is positioned so that the striker rod, when extended, fires the weapon through the trigger, and it moves to a retracted position as the rotor moves out of the way. The rotor is supported on a shaft which extends to the exterior of the housing, there being a handle attached to the outer end of the shaft by means of a nut, the handle having a lateral tip supporting a knob adapted to be grasped by the user. The knob is held and rotated in operation.

BRIEF DESCRIPTION OF THE DRAWINGS

FIG. 1 shows the semiautomatic weapon attachment of the present invention attached to a trigger guard and further discloses details of construction with a portion broken away and shown in sectional view; and FIG. 2 is a view orthagonal to FIG. 1 showing details of construction of the rotor within a housing for operation of the accessory of the present invention.

DETAILED DESCRIPTION OF THE PREFERRED EMBODIMENT

Attention is first directed to FIG. 1 of the drawings, where the present apparatus is identified by the numeral 10. The numeral 12 identifies the stock of a weapon, typically a 22-caliber semiautomatic weapon. The make and construction of the weapon is subject to variation. The weapon includes a stock 12 which encloses the bolt and trigger operating mechanism. It also encloses the magazine which feeds ammunition to the firing chamber. The weapon further includes a trigger guard 14 positioned about the trigger 16. The trigger 16 is mounted on a pivot within the stock 12, urged by a spring to a forward position and is ordinarily finger manipulated to fire. There is a specified resiliency in the spring and mounting mechanism for the trigger which urges it back to a forward position after firing. This resistance in the trigger mounting mechanism is utilized in cooperation with this invention to restore the trigger to the forward position after it has been pushed to the back or firing position by the present invention.

The present apparatus selectively clamps to the trigger guard 14. To achieve clamping, it is first positioned at a desired location adjacent to the trigger 16 in the forward position, the position where the weapon has not been fired. The attachment 10 incorporates an L-shaped mounting bracket 20 which circles around and beneath the trigger guard 14. The bracket 20 extends beneath the trigger guard 14 and facially contacts it, defining what might be termed a slot through the apparatus to receive the trigger guard. The upper face 22 of the bracket is provided for this purpose.

The trigger guard 14 is clamped. Clamping is achieved by a pair of clamping screws 24 which are threaded into tapped holes drilled in the bracket 20. The clamping screws thread through the holes and are of sufficient length to enable them to be tightened through the use of a screwdriver to clamp against the bottom side of the trigger guard and to force it upwardly against another portion of the attachment 10. It will be observed that the trigger guard is received in a slot above the bracket 20 and below an attached housing 26. The housing 26 is fixedly attached to an upstanding arm 28 on the bracket. The housing 26 is generally cylindrical, having a pair of parallel, generally circular faces 30 and 32 which are spaced from one another. The end faces support a shaft 34, the shaft 34 passing through the end faces to support a rotor 36. The rotor 36 rotates with the shaft in a manner to be described.

As shown in FIG. 1 of the drawings, the housing 26 is generally circular in cross section, except it includes an extension 40. The extended portion 40 defines one wall of a tangential passage. The opposite wall 42 is spaced from it, the walls 40 and 42 enclosing a striker rod 44. The striker rod 44 is mounted in the slot between the walls 40 and 42 which are below and above it and is received between the generally circular end walls 30 and 32. The slot thus captures the striker rod 44. The striker rod is generally rectangular and fits snugly, but not in a binding manner in the slot so that it can reciprocate. It is preferably formed of a high quality plastic and has a relatively snag-free surface. It slides with a minimum of friction in the slot. It is sized so that it does not wobble in the slot or otherwise become canted. It is constructed in rectangular fashion, but the sharp corners and edges are deburred and slightly rounded to a suitable radius. The striker rod 44 slides in the slot, extending into the interior of the housing 26. The rotor 36 is equipped with a plurality of protruding striker cams (four in the preferred embodiment). Each cam incorporates a shoulder 46 which is near the outer tip and which is defined as a radial line relative to the axis or shaft 34 and is able to rotate with the shaft to strike the striker rod 44 and urge it to the right as viewed in FIG. 1. The apparatus is scaled such that the striker rod slides by a distance to bring it into contact with the trigger to push the trigger from the forward or nonfiring position backward to the firing position. Moreover, the corners of the cam 46 are gently rounded so that it can ride over the striker rod. As it rotates in a counterclockwise direction as viewed in FIG. 1, the cam rides over, leaving a gap between cams so that the spring mounting mechanism in the weapon, itself, will return or restore the trigger to its forward position and thereby push the striker rod forwardly. The striker rod thus has two positions, one being the forward or nonfiring position and the other position being the firing position where it is extended against the trigger. These two positions are achieved on rotation of the rotor coacting with the resilient mounting mechanism in the weapon, itself. As will be observed on viewing FIG. 1, the cams ride over the striker rod as it moves to the rear or out of the locus of the cams.

In FIG. 2 of the drawings, the shaft 34 incorporates a bolt 48 which is axially threaded at one end and which protrudes beyond the housing 26. It supports a handle 50, the handle extending laterally by a suitable distance to support a knob 52. The knob 52 is grasped by a user and rotated. The handle 50 is locked in place by means of a cap nut 54. The handle 50 is hand rotated to fire the weapon. Operation is relatively simple. The clamp screws 24 are threaded to a clamping position to clamp adjacent the trigger 16. Some adjustment in position is permitted so that the rod 44 strikes the trigger, pushing it to the firing position. The rod 44 retracts sufficiently to enable the trigger to spring forwardly to its nonfiring position. This stroke distance is designed into the cam and rotor as, for instance, a stroke of 1.0 centimeter. The handle 50 is rotated to rotate the cams 46 counterclockwise (FIG. 1) to reciprocate the striker rod 44 against the trigger 16. The trigger is repetitively struck to fire four times for each revolution. A change in scale values can vary the firing rate. Removal and reinstallation is easily accomplished by a screwdriver.

The foregoing is directed to the preferred embodiment, but the scope is determined by the claims which follow.

I claim:

1. An apparatus for use with a semiautomatic firearm having a trigger enclosed within a trigger guard, comprising:

(a) clamp means adapted to be releasably attached to a trigger guard;

(b) rotor means pivotally supported by said clamp means;

(c) manually operated handle means connected to said rotor means for rotation on hand operation to impart rotation to said rotor means; and (d) movable striker means supported by said clamp means and positioned to move toward a trigger and contact thereagainst to discharge the firearm through operation of the trigger, said striker means moving on operation of said rotor means.

2. The apparatus of claim 1 wherein said rotor means comprises a central rotatable bushing having an axis and further including a protruding cam means having a surface making camming contact against said striker means.

3. The apparatus of claim 2 including an elongate, sliding alignment surface positioning said striker means and wherein said striker means includes an elongate member having two ends, one end making camming contact with said cam means and the other end thereof selectively striking the trigger.

4. The apparatus of claim 3 further including an elongate bolt in said bushing to support and align said bushing and further connecting said handle means for rotation along a locus laterally located for the trigger guard.

5. The apparatus of claim 4 wherein said bolt and said handle means rotate as a unit and said handle means is positioned for rotation in a full circle.

6. The apparatus of claim 1 wherein said clamp means comprises a clamp surface, at least one clamping member and means positioning said clamping member spaced from said clamp surface to enable selective closure toward and about the trigger guard in coaction with said clamp surface.

7. The apparatus of claim 1 wherein said rotor means comprises a round bushing having an axially located bolt therein and further supporting evenly spaced, circumferentially located, protruding cam means for forceably engaging said striker means to fire the firearm on each operation of the trigger at the urging of said striker means.

* * * * *